US006851227B1

(12) United States Patent
Schildge, Jr.

(10) Patent No.: US 6,851,227 B1
(45) Date of Patent: Feb. 8, 2005

(54) RETRACTABLE ROOF FOR A MALL OR OTHER SPACE

(76) Inventor: Adam T. Schildge, Jr., 899 Green St., San Francisco, CA (US) 94133

( * ) Notice: Subject to any disclaimer, the term of this patent is extended or adjusted under 35 U.S.C. 154(b) by 0 days.

(21) Appl. No.: 10/163,768

(22) Filed: Jun. 5, 2002

Related U.S. Application Data

(60) Provisional application No. 60/296,190, filed on Jun. 5, 2001.

(51) Int. Cl.[7] ..... E04B 1/346

(52) U.S. Cl. ..... 52/66; 52/6; 52/81.2

(58) Field of Search ..... 52/66, 6, 64, 83, 52/80.1, 65, 69, 81.2, 81.3

(56) References Cited

U.S. PATENT DOCUMENTS

| | | | | |
|---|---|---|---|---|
| 1,239,421 A | | 9/1917 | Metzger | |
| 2,094,801 A | | 10/1937 | Mass | |
| 3,277,619 A | | 10/1966 | Miller et al. | |
| 3,465,483 A | | 9/1969 | Miller | |
| 3,589,084 A | | 6/1971 | Reed | |
| 3,766,691 A | | 10/1973 | Ray | |
| 3,815,299 A | | 6/1974 | Sorensen et al. | |
| 4,283,889 A | | 8/1981 | Dunn | |
| 4,831,792 A | * | 5/1989 | Berger | 52/66 |
| 5,063,730 A | | 11/1991 | Muramoto et al. | |
| 5,167,097 A | * | 12/1992 | Robbie et al. | 52/6 |
| 5,394,660 A | | 3/1995 | Haris | |
| 5,555,683 A | * | 9/1996 | Schroeder | 52/200 |
| 5,653,066 A | | 8/1997 | Schildge, Jr. | |
| 5,848,499 A | | 12/1998 | Schildge, Jr. | |
| 5,896,708 A | * | 4/1999 | Doi et al. | 52/66 |
| 5,983,575 A | | 11/1999 | Reppas | |
| 6,082,054 A | | 7/2000 | Silberman et al. | |
| 6,145,254 A | | 11/2000 | Silva | |
| 6,367,206 B1 | | 4/2002 | Silberman et al. | |
| 6,415,556 B1 | * | 7/2002 | Silberman et al. | 52/66 |

OTHER PUBLICATIONS

Con–Slide Support Bearing Systems, Brochure, © 1998.
Infill sheet for Rollamatic Roofs Incorporated, Common Installation Types, San Francisco, CA, undated.
Brochure for Open Aire, Open Up To The Possibilities, issue 13150/OPE, Canada, undated.
Brochure for Rollamatic Roofs Incorporated, The Ultimate Skylight, undated.
David R. Rosenbaum, Seeing Red Over Green, Engineering News–Record, Feb. 9, 1998, pp. 30–33.
Brochure for Structures Unlimited, Inc., Pool Enclosure Systems, Manchester, NH, 1999, undated.
Stadia (Magazine), Four Poster Bid, pp. 10–14; World Stage, pp. 27–31; Enron Field, pp. 59–62; A Breath of Fresh Air, pp. 63–66; Oct. 1999 Showcase Special.

* cited by examiner

*Primary Examiner*—Carl D. Friedman
*Assistant Examiner*—Chi Q Nguyen
(74) *Attorney, Agent, or Firm*—Thelen Reid & Priest LLP; John K. Uilkema

(57) ABSTRACT

The invention concerns a structural and mechanical means to build a large retractable roof, that can have the shape of a barrel vaulted roof or a pitched vaulted roof or a flat roof. The roof is moved as one monolithic roof on and off a mall walkway or other structure. The roof cover is a glass skylight or other material.

44 Claims, 16 Drawing Sheets

RETRACTABLE ROOF FOR A MALL OR OTHER SPACE

RELATED APPLICATION

This application is based upon and claims the benefit of Provisional Application 60/296,190, filed Jun. 5, 2001.

BACKGROUND OF THE INVENTION

To make retractable a very large roof so as to move it completely off the space it covers presents new challenges. Such a roof may be a barrel vaulted roof hundreds of feet long, or a pitched roof hundreds of feet long, or even a flat roof hundreds of feet long. The object is to move such a roof as one unit. The object also is to move the flat roof in sections.

The state of the art today shows no quick answer to these requirements. There are smaller retractable roofs often made of plastic or glass used over swimming pools and garden courts. There are unit skylights of various shapes either in glass or plastic that are made to slide. There are custom roofs in either glass, plastic, or other material. None of these roofs show how to move a large barrel vaulted roof, a pitched roof, or a flat roof in the large size required, completely on and off the opening they cover.

When the roofs become very large, one of the new issues is the temperature expansion of the retractable roof versus the supporting structure. In new stadiums this is sometimes accounted for by partially articulated wheel trucks. On smaller roofs this is sometimes accounted for by expansion and contraction of the retractable roof frame taken by sideway movement of the wheels on the supporting rails of the roof. In this invention the effort is not to mitigate the expansion and contraction movement of the roof on the wheels, but to create a system where the rail for the roof supporting wheels moves closely the same as the roof from temperature expansion and contraction, so no thermal expansion and retraction accommodating means are needed at all between the roof and the wheels. This is done by supporting the rail on an intermediate frame which spans the area being covered so that the rail and the support therefore will expand and contract as one. To manage this, the intermediate frame is supported on slide bearings resting on columns, or possibly walls or another beam structure, so that it is free to move in unison with the roof, both exposed to similar temperatures. In this manner the roof and wheels see limited to small differential movement so no measures such as articulated frames or rollers or even slide bearings are needed between the roof and the wheels.

This alone does not assure that the roof can be moved evenly. The retractable frame that is moved must be very rigid. Rigidity in panelized roofs on stadiums extends only to the individual panels. This invention moves the entire roof as a monolithic piece and therefore requires bracing of the entire roof. This is done very simply with X bracing or other forms of bracing in the retractable roof.

Thirdly to move a large monolithic roof evenly requires that the drive means, the wheels with attached motors or a cable and winch system, the two most common, must work evenly together. Other stadium roofs use various means of electro mechanical controls to assure one side moves the same as the opposite side so the roof moves evenly. Some stadiums use controls that measure the exact location of the sliding wheels at all times and correct motor speeds to adjust continuously so that the roof runs evenly. In other words so that one side reaches the end point at the same time as the other. Although this could be done with the roof in this invention, this invention uses X bracing in a horizontal frame supporting the roof to transfer differential traction forces directly between the wheels and motors which drive the roof. Direct transfer of traction forces evens out the movement of all the motors and wheels contributing to an even parallel movement of the roof. This invention also uses motors on all wheels. At the same time redundancy is achieved. Should one motor fail, the loss will be taken up by the others.

It is these ideas brought together in an artful and engineered manner that result in a smooth operating very large retractable roof to be used on a mall or other large area, which has never been done in this or a similar manner.

The following drawings together with the detailed description will describe this further.

SUMMARY OF THE INVENTION

The invention shows how to move a long barrel vaulted retractable roof on and off a space such as a mall walkway. A frame is built on a series of support columns with intermediary slide bearings to allow for temperature expansion and contraction. Over the frame rails are built on which the barrel vaulted roof can slide. The frame members are spaced at intervals, the length of the mall walkway. In so doing the barrel vaulted roof is built as one section which expands and contracts similar to the frame, allowing smooth movement. Motors are attached to the wheels of the frame of the barrel roof and X bracing is interwoven between the members of the frame, to provide a transfer of traction forces to permit even movement.

Reference Numbers

Figure 1:
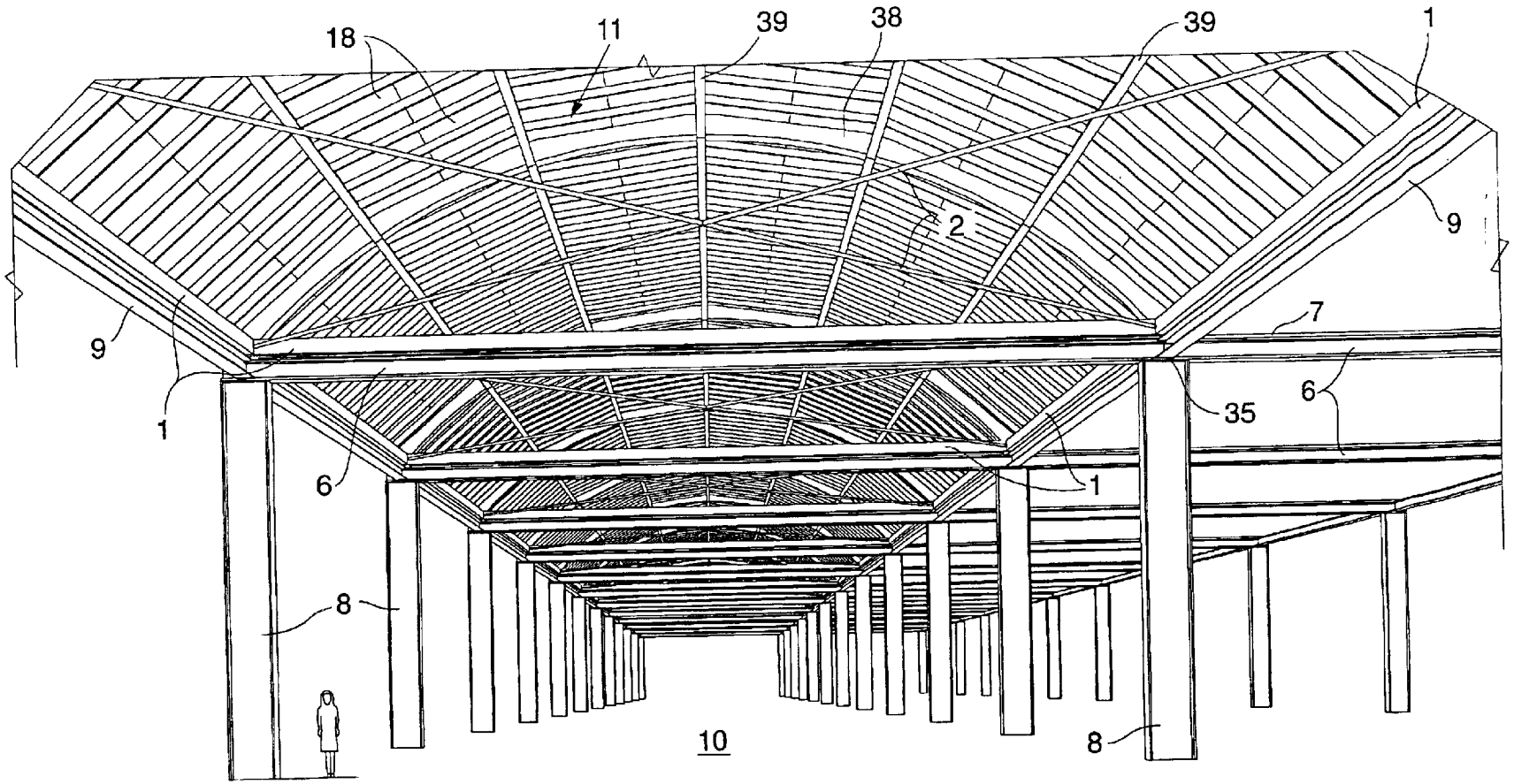
FIG. 1 is a perspective view from a bottom vantage point, showing the retractable roof system of FIG. 2A, with the roof in closed condition.
Figure 2:
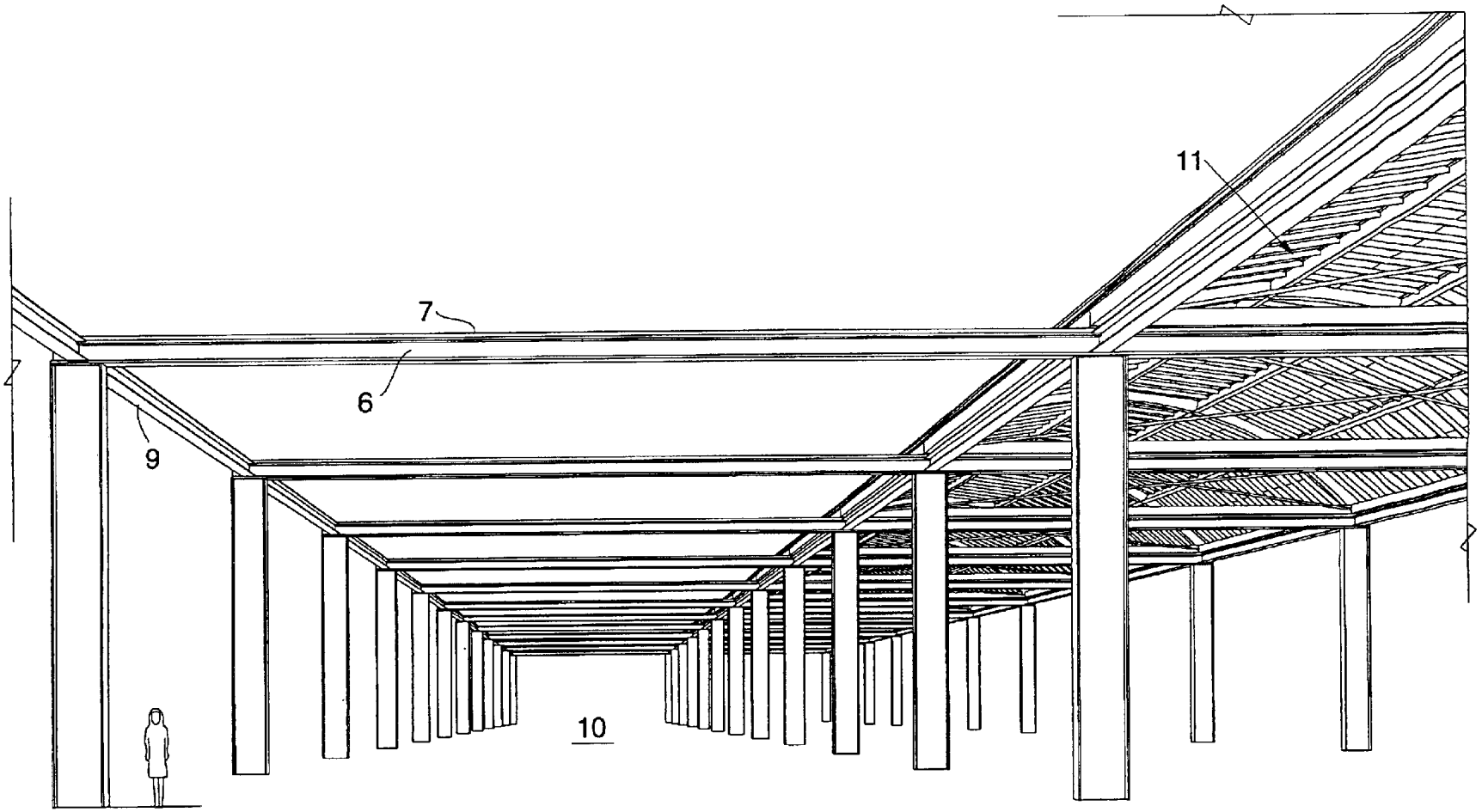
FIG. 2 is a perspective view corresponding to FIG. 1 showing the retractable roof system of FIG. 2A, with the roof in open condition.
Figure 2A:
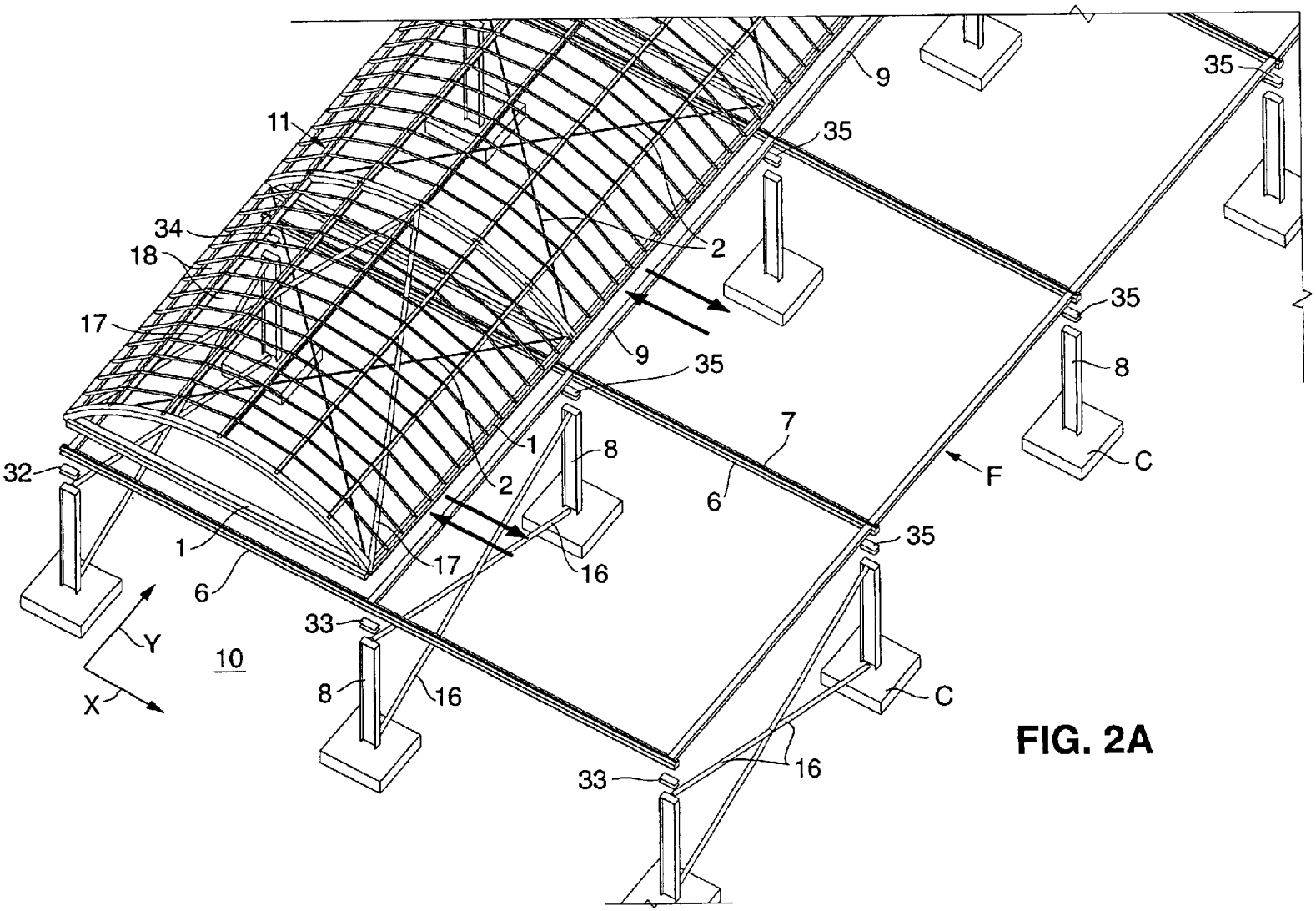
FIG. 2A shows an exploded perspective view, with parts thereof broken away, showing the inventive retractable roof system from a top vantage point, with a roof of an elongated barrel vaulted configuration.
Figure 2B:
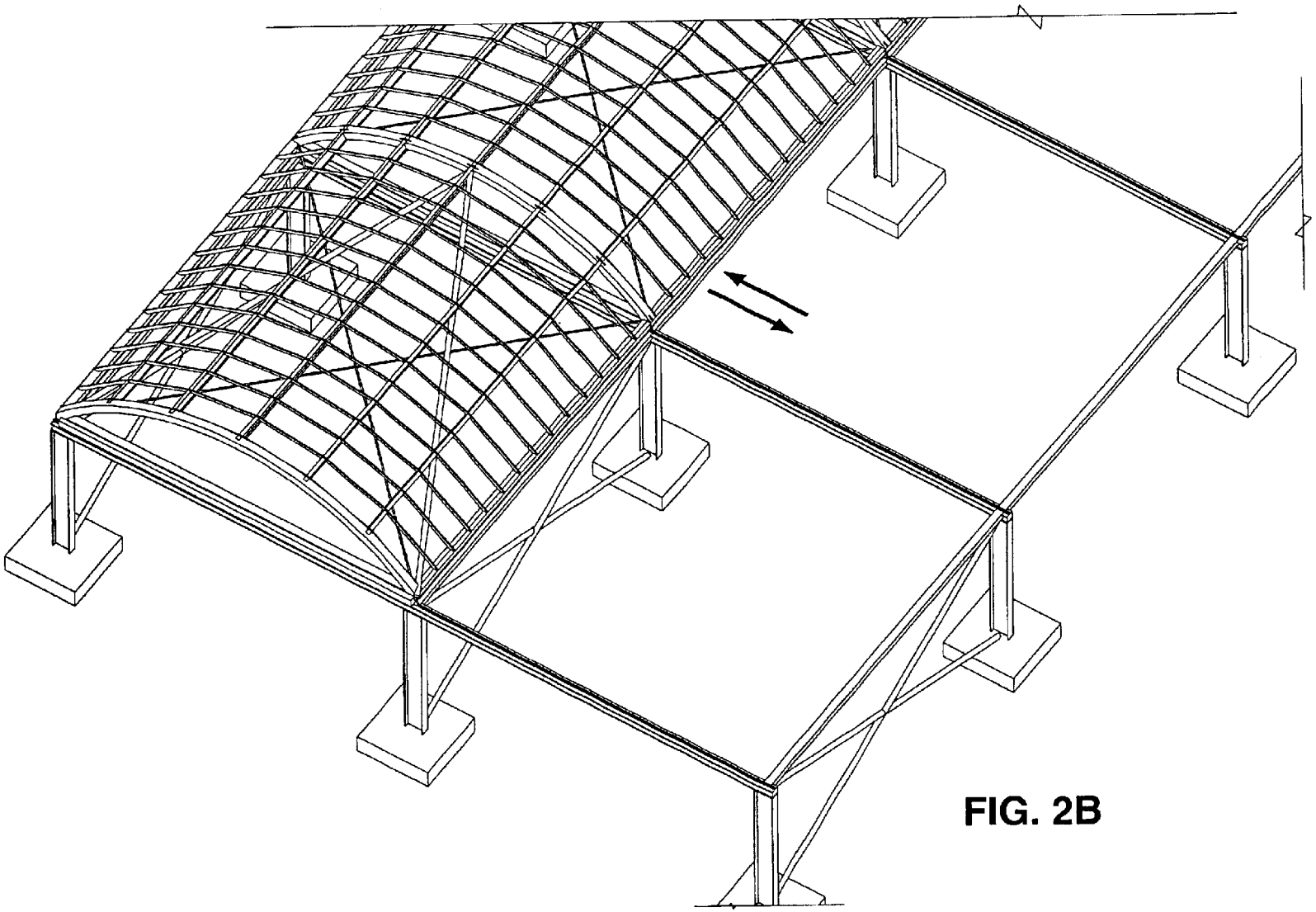
FIG. 2B is a non-exploded perspective view corresponding to FIG. 2A.
Figure 2C:
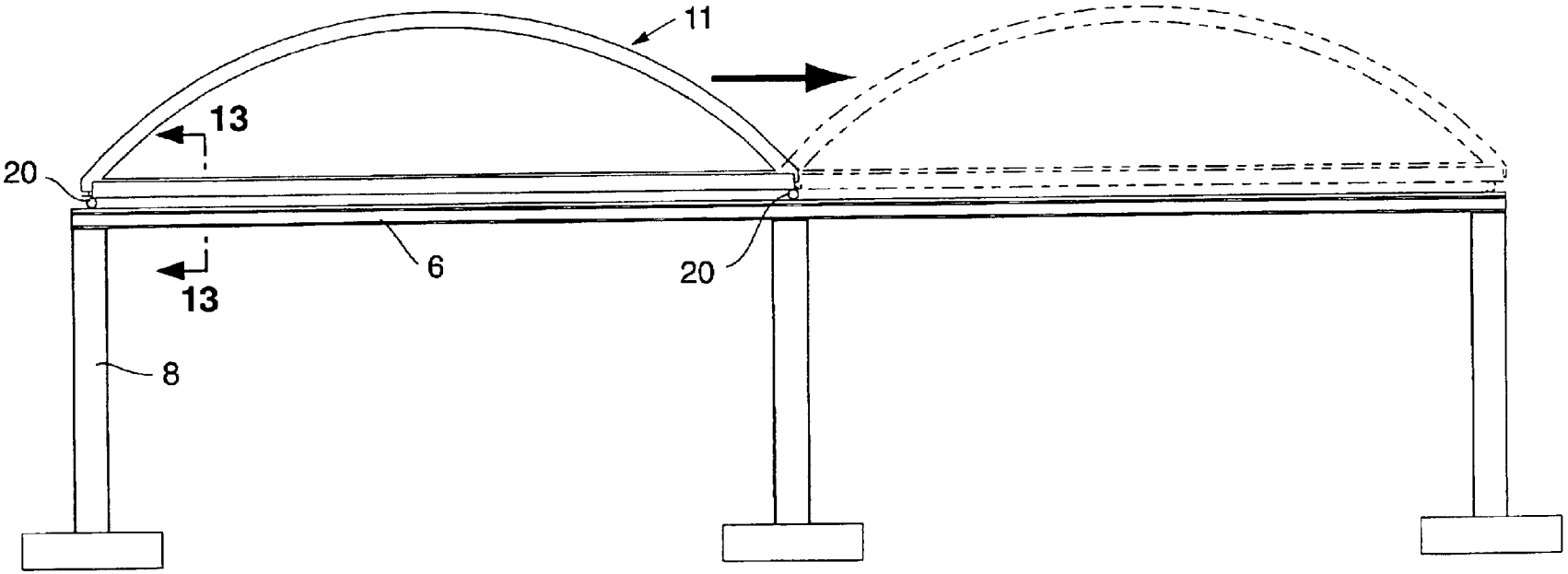
FIG. 2C is an end view of the retractable roof system of FIG. 2A, with phantom lines depicting the roof structure in the open condition.

1. supporting framework
2. X bracing of the supporting framework.
3. rigid corner connections of the supporting framework
4. rectangular framework of the supporting framework
5. shear diaphragm of the supporting framework
6. parallel beam
7. rail
8. column
9. intermediary beam
10. mall walkway or other space
11. monolithic retractable barrel vaulted roof
12. monolithic retractable pitched vaulted roof
13. monolithic retractable flat roof
14. segmental retractable flat roof
15. drainage channel
16. column end bracing
17. roof end bracing
18. glass
19. wheel motor
20. wheel
21. power rail
22. winch motor
23. cable
24. motor
25. chain
26. pinion gear
27. rack
28. worm screw
29. piston rod
30. cylinder
31. retractable roof
32. fixed bearing pad
33. sliding bearing pads fixed in Y, free to move in X
34. sliding bearing pads fixed in X, free to move in Y
35. sliding bearing pads free to move in X and Y
36. wind lock
37. shaft
38. arch member
39. longitudinal framing
40. sliding section edge
C. foundations
F. intermediate frame
Y. longitudinal direction
X. short direction

DESCRIPTION OF THE PREFERRED EMBODIMENT

The preferred embodiment of the invention is the retractable barrel vaulted skylight roof. Other embodiments are the retractable vaulted pitched skylight roof, the retractable monolithic flat skylight roof, and the retractable segmental flat skylight roof. This description will describe the barrel vaulted roof, and in the end describe some of the differences with the others.

Foundations C make the primary support of the roof. On the foundations columns 8 extend to the under level of the retractable roof. At this point the roof may also be supported by other roof framing or it may be supported on walls. In the any case at this level and on top of the supporting structure, in the preferred embodiment columns 8, are sliding bearing pads 32 to 35. The bearings permit the roof to expand and contract for temperature. The slide bearing pads permit the roof to expand and contract in the longitudinal direction as one monolithic structure. Along one long side of the roof the bearing pads 34 are free to allow movement in the longitudinal direction Y and yet not permit movement in the short direction. On the bearing pads 35 the roof is free to move in both directions. However, at one end of the longitudinal direction the bearing pads 33 allow only movement in the short direction and no movement in the long direction. The bearing pads 32 are fixed in the X and Y directions. The advantage of this will follow.

On the bearing pads rest parallel beams 6 spanning the opening of the roof. These beams extend an equal distance to one side and over adjoining buildings. These beams are parallel to one another. These beams are the primary supporting beams on which the roof rolls to one side to open or close the roof.

Between these parallel beams 6 are intermediate beams 9 that are perpendicular to the parallel beams spanning in the longitudinal direction of the roof at the bearing pads. The beams 6 and 9 form a unitary intermediate frame F.

As now becomes apparent the frame of the parallel beams 6 and the intermediate beams 9 makes one continuous piece that can move for temperature expansion and contraction in the long and the short direction on the bearing pads while being fixed at one long end and fixed in the short direction of the frame at each parallel beam 6. A 100 degree Fahrenheit change in temperature for the steel frame in 600 feet length would have a change in length of approximately 4.8 inches.

The columns at one end of the long direction of the roof are braced by bracing 16. The moveable roof is braced by bracing 17 between the top of the roof and its lower cord.

Bracing may be installed at the columns in the short direction of span also, but the columns and the foundation can also offer this support.

This to now gives a structure on which the retractable roof can be built. The intermediate frame forming part of this structure is free to move for temperature expansion and contraction.

On this structure on the parallel beams 6 are rails on which the roof can slide.

On the rails 7 are wheels 20 supporting the roof. Attached to the wheels are motors 19 in the preferred embodiment.

Figure 16:
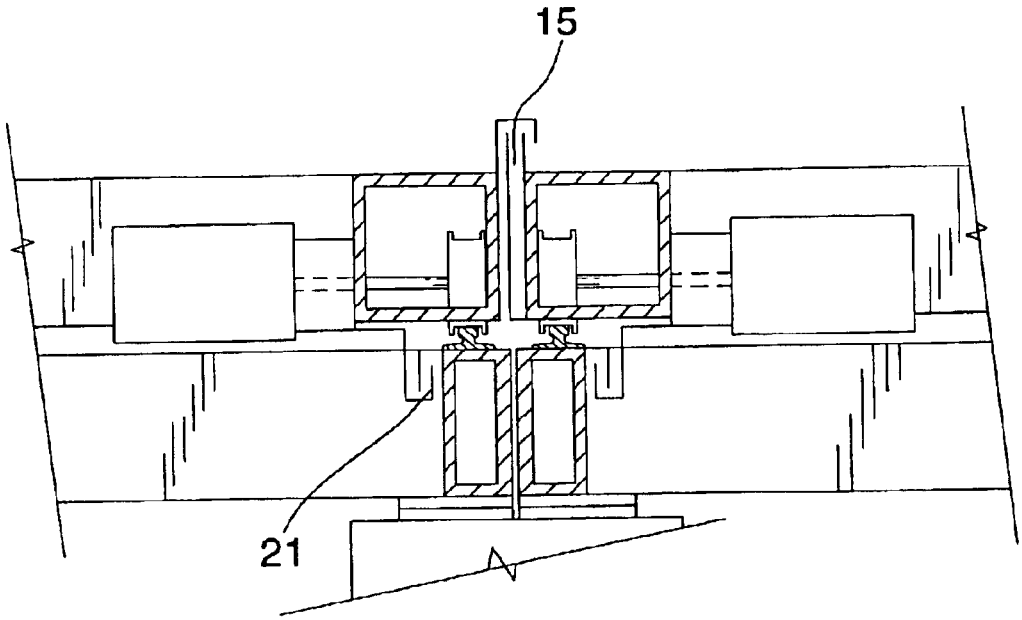
FIG. 16 is a cross-sectional view of the segmental retractable roof of FIG. 7 at an edge cross-section similar to FIG. 13 illustrating a drainage channel of the segmental retractable flat roof.

Attached to the parallel beams 6 are where needed power rails 21 (FIG. 16) from which the motors 19 are powered.

Supported on the wheels is a supporting framework 1 for the roof. This is a continuous rectangular framework 1. The wheels are built in to it.

It extends the length of the barrel vaulted roof. The barrel vaulted roof rests on this framework and moves with it. The pitched and flat roof of the alternative designs also rest on this supporting framework.

Figure 9:
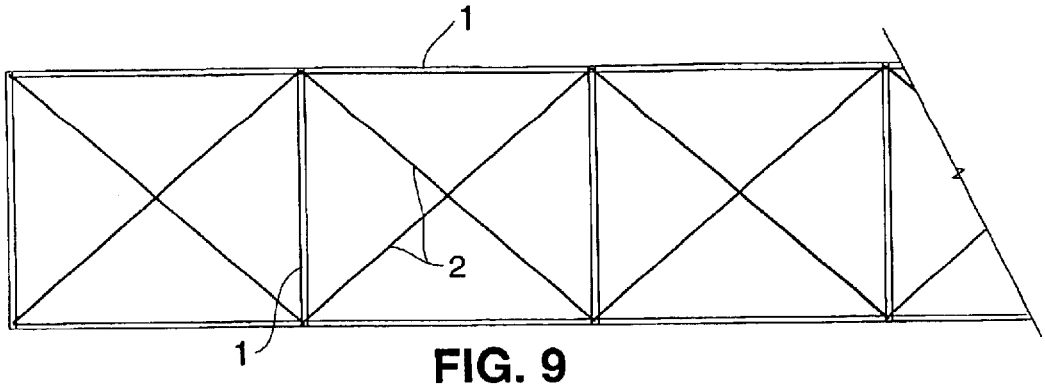
FIG. 9 is a plan view, with parts thereof broken away, showing the roof framework of the present invention with internal X bracing.
Figure 10:
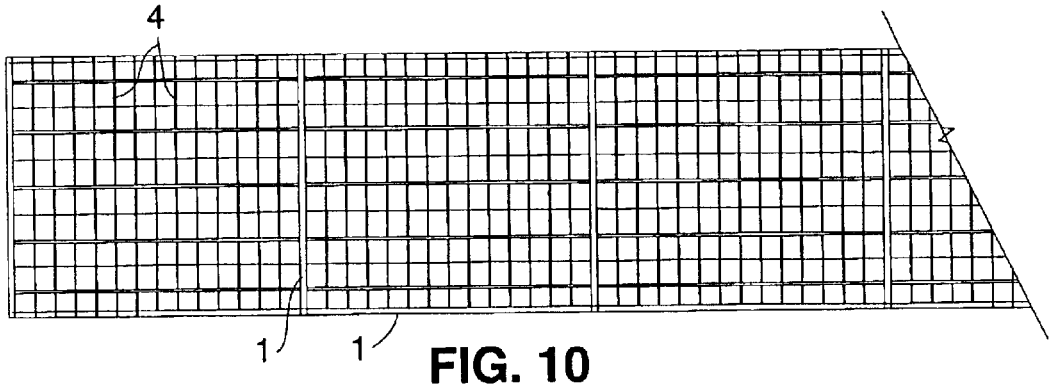
FIG. 10 is a plan view, with parts thereof broken away, showing the roof framework of the present invention with internal grid elements used for bracing.
Figure 11:
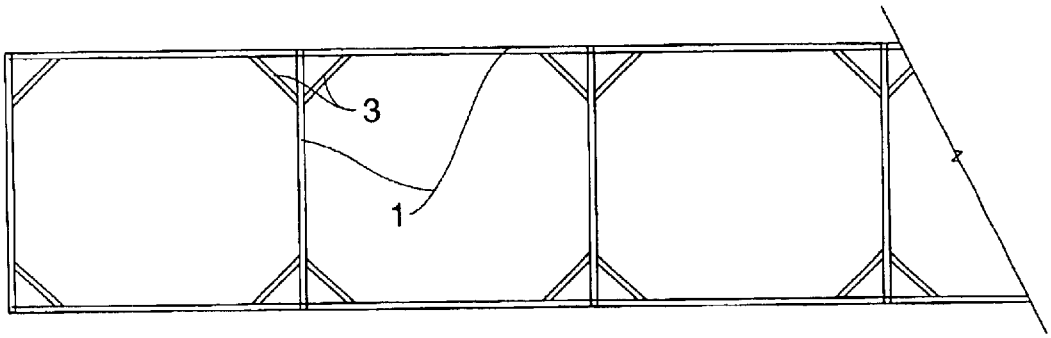
FIG. 11 is a pan view, with parts thereof broken away, showing the roof framework of the present invention with internal corner bracing.
Figure 12:
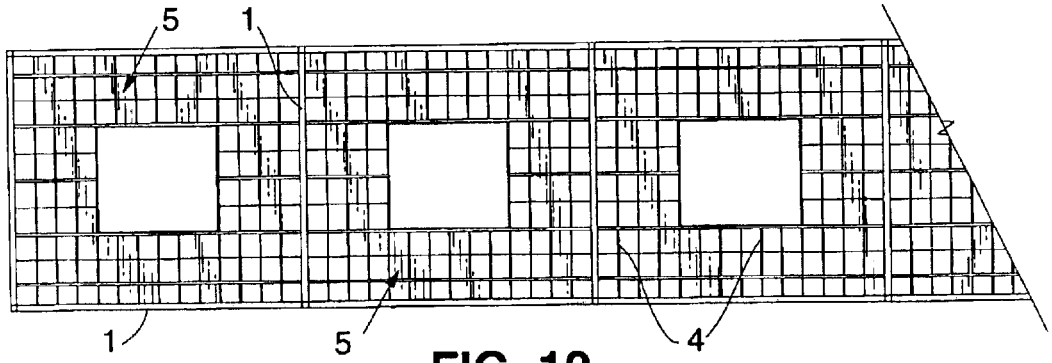
FIG. 12 is a plan view, with parts thereof broken away, showing the roof frame of the present invention with internal diaphragm bracing.
Figure 14:
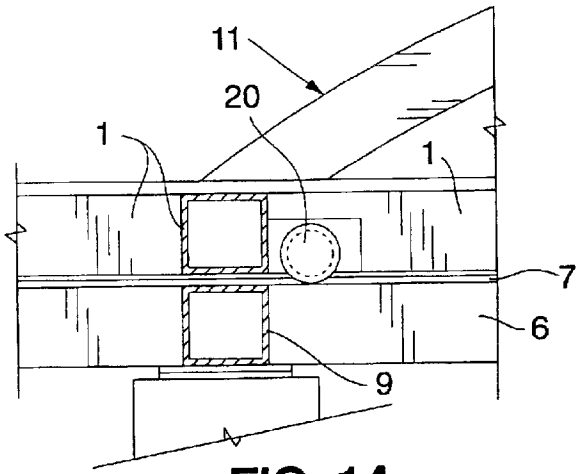
FIG. 14 shows the FIG. 13 from the side.
Figure 13:
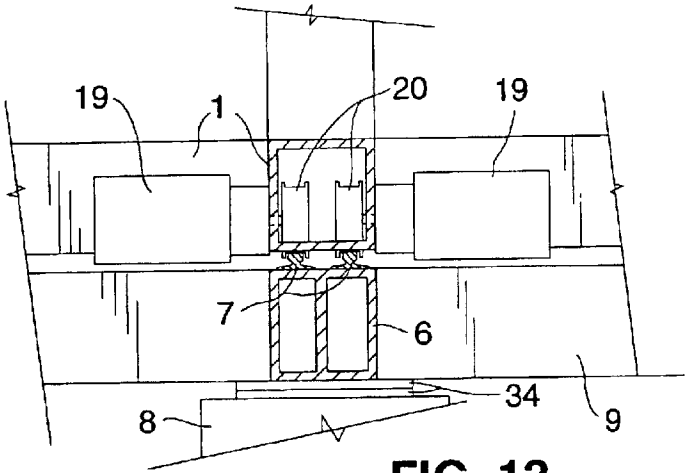
FIG. 13 is a cross-sectional elevation view taken on the plane designated by the line 13—13 in FIG. 2C, illustrating an embodiment of the inventive retractable roof system wherein motor driven wheels are used to move the retractable roof, with a separate motor provided for each wheel.

This supporting framework 1 is braced in the preferred embodiment with X bracing, FIG. 9. Other bracing, as shown in FIGS. 10, 11, and 12 may also be used. The bracing is very important as it does two things. It assures that the supporting framework does not skew which would damage the barrel vaulted roof particularly the glass cover. It does this by transferring motor traction from one motor to another to balance traction among all the wheels to assure even movement of the roof without skewing. This feature also serves as a redundant back-up if one motor goes out. The lost traction is taken up by the others through the X bracing of the preferred embodiment.

The barrel vaulted roof comprises arch members that sit on the supporting framework 1 with the arch haunch points supported by the motorized wheels 20. Between the arch members is longitudinal framing 39 and between the longitudinal framing is smaller framing. Between the smaller framing is glass or other covering means.

At one end of the barrel vaulted roof is bracing 17 supporting the arches in the longitudinal direction of the roof.

The structure of the retractable barrel vaulted roof is one piece. The structure below the wheels, frame F, is another single piece. Both are free to move from temperature. The two structures are exposed to approximately the same temperature, therefore the relative movement one to the other is minimum.

This relative movement is important as it allows the wheels which have flanges to ride always evenly on the rails without the flanges rubbing against the rails with such force that they would prevent the roof from moving.

Figure 17:
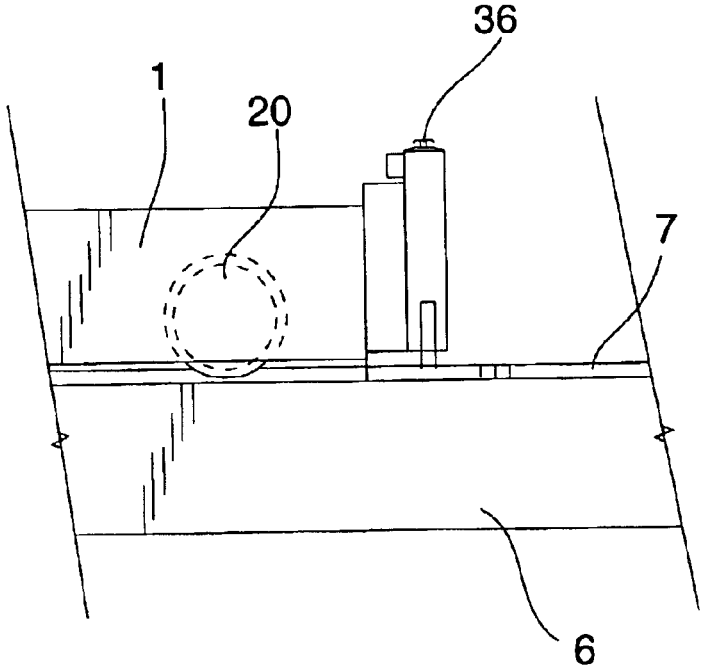
FIG. 17 is a side view schematically drawn showing a wind lock which may be used with the roof of the present invention.

This completes the description of the barrel vaulted retractable roof. As the roof is exposed to wind and as the force to move the roof is relatively low, the wind if too high would move the roof. To avoid this a wind lock 36 is installed to the retractable roof (see FIG. 17). It measures the wind speed and at a programmed speed automatically clamps the roof fixed against movement.

Figure 3:
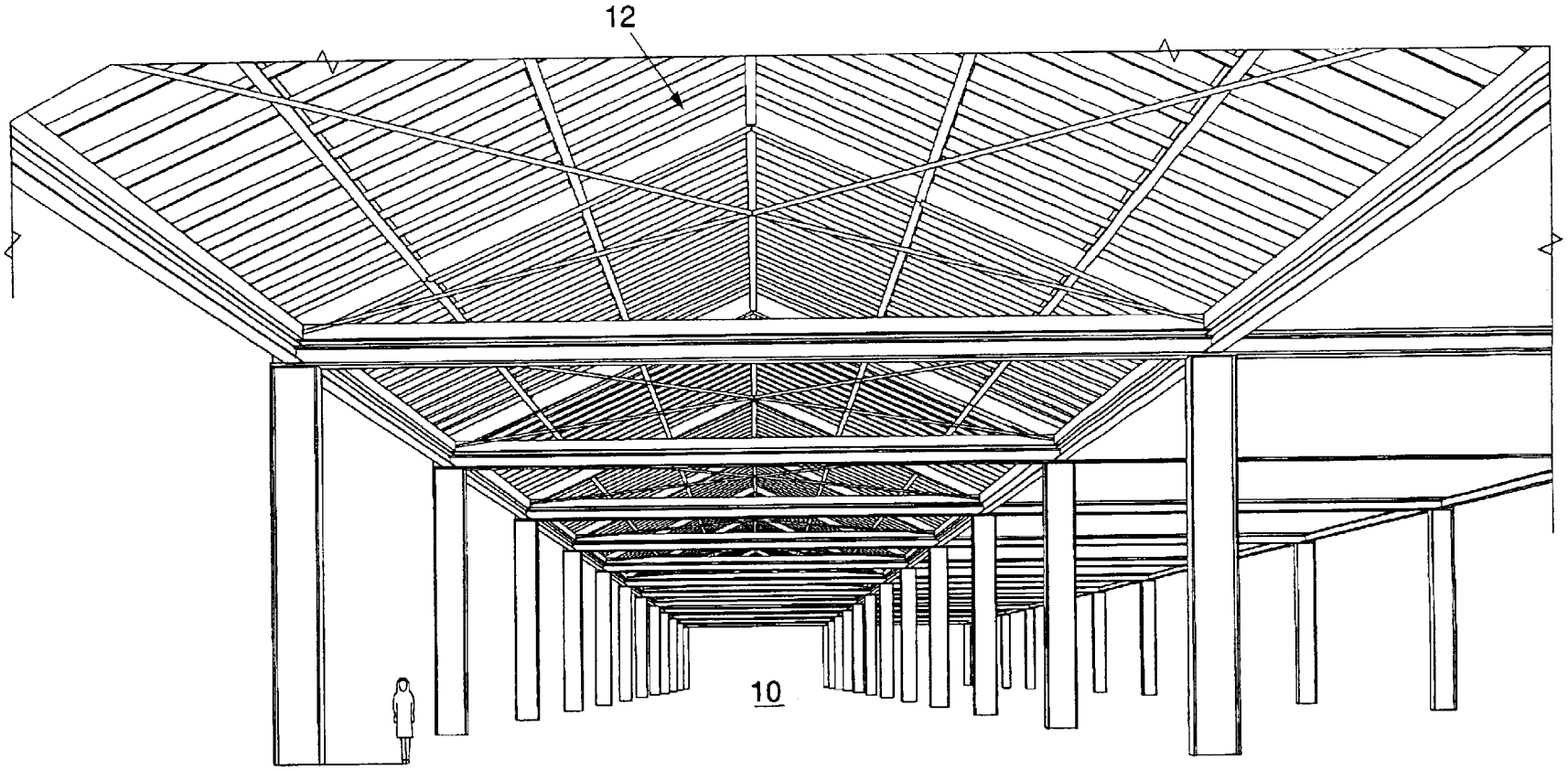
FIG. 3 is a perspective view corresponding to that of FIG. 1 modified to show a roof of an elongated peaked configuration in closed condition.
Figure 4:
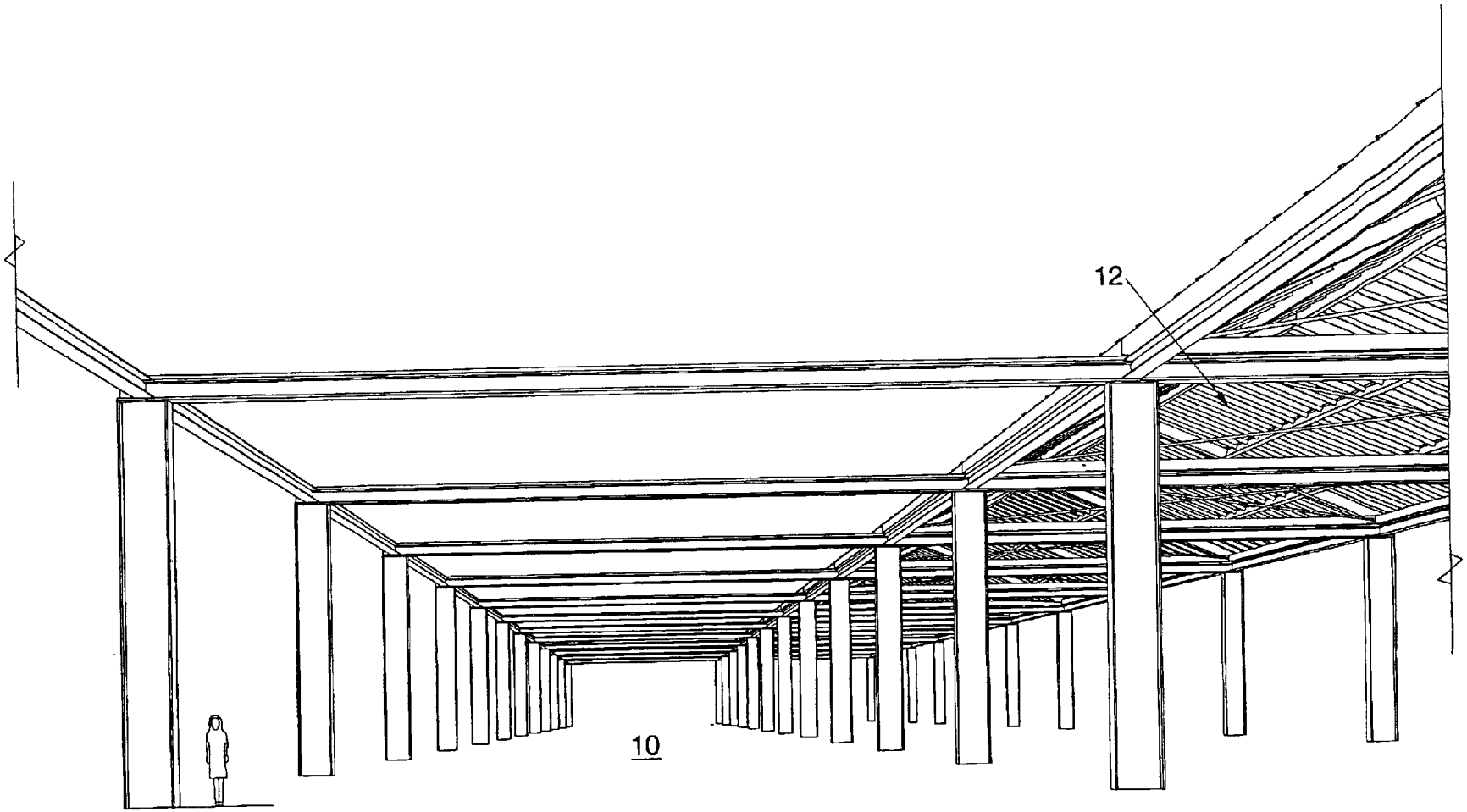
FIG. 4 is a perspective view corresponding to that of FIG. 2 modified to show a roof on an elongated peaked configuration in open condition.
Figure 5:
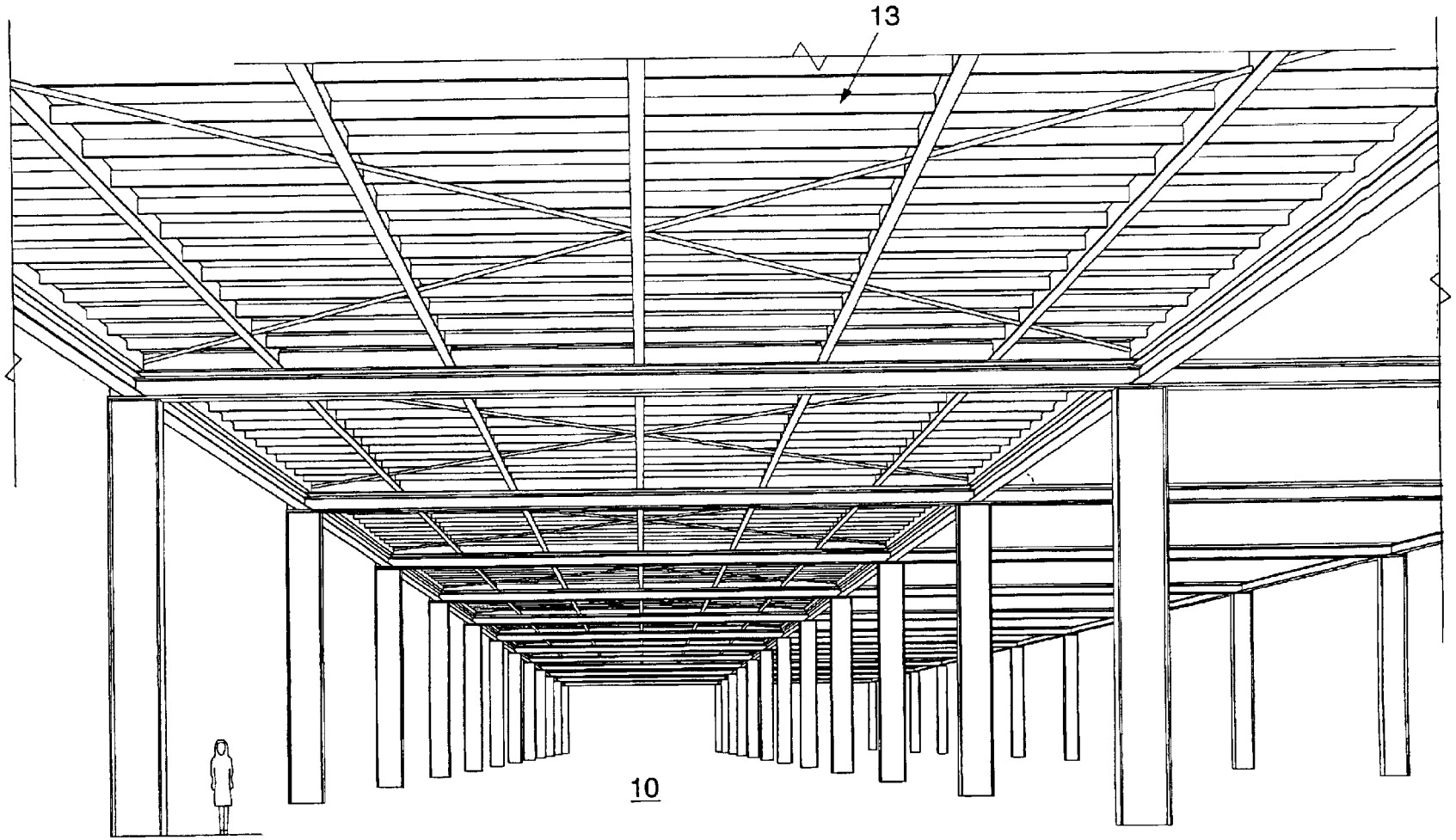
FIG. 5 is a perspective view corresponding to that of FIG. 1 modified to show a roof of a flat configuration in closed condition.
Figure 6:
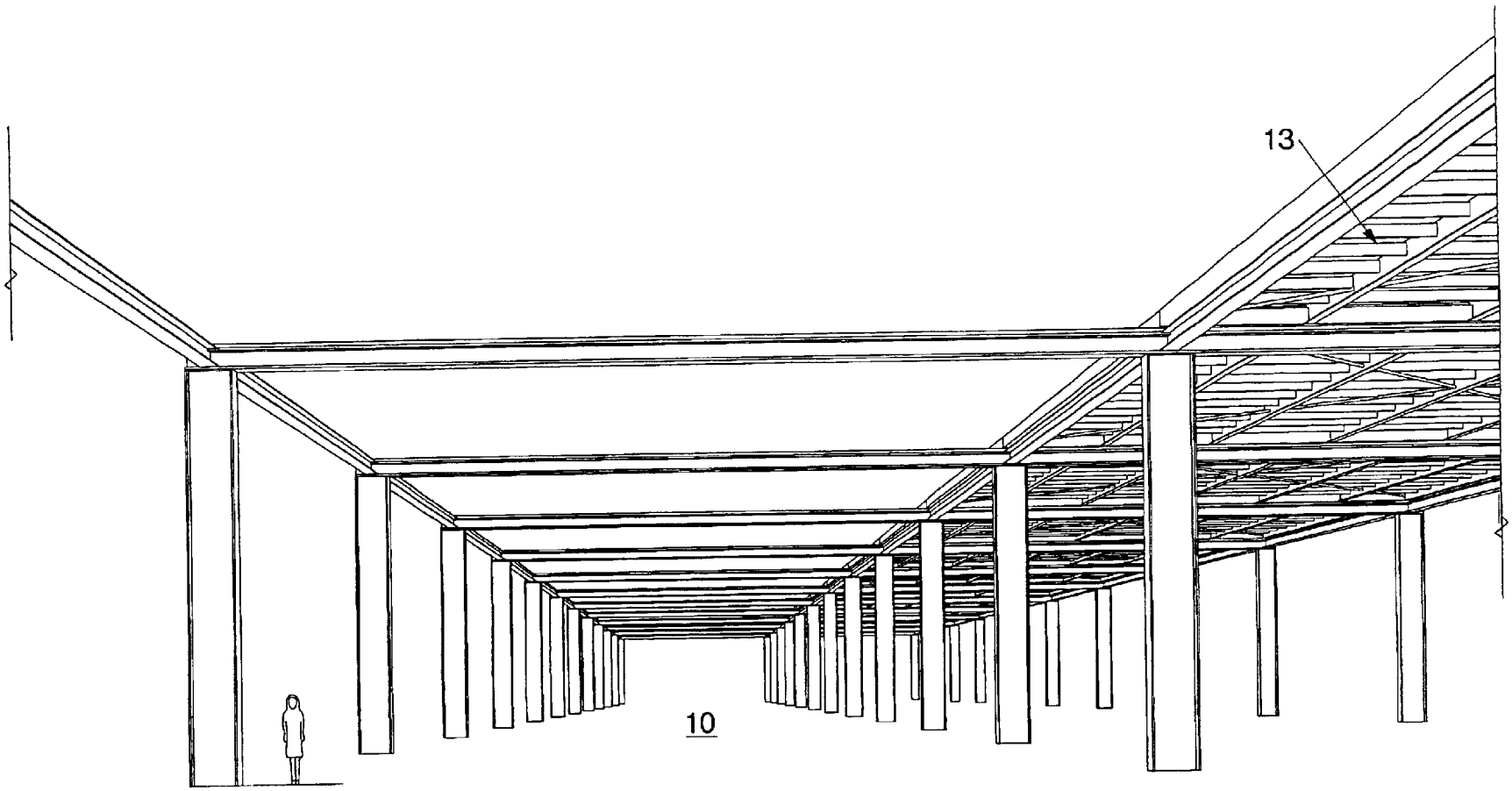
FIG. 6 is a perspective view corresponding to that of FIG. 2 modified to show a roof of a flat configuration in open condition.

Alternative ways to build the roof may be a pitched vaulted roof as shown in FIGS. 3 and 4. The design differs only from the above by the shape of the structure set over the supporting framework 1. The same holds true for the flat retractable roof shown in FIGS. 5 and 6.

Figure 7:
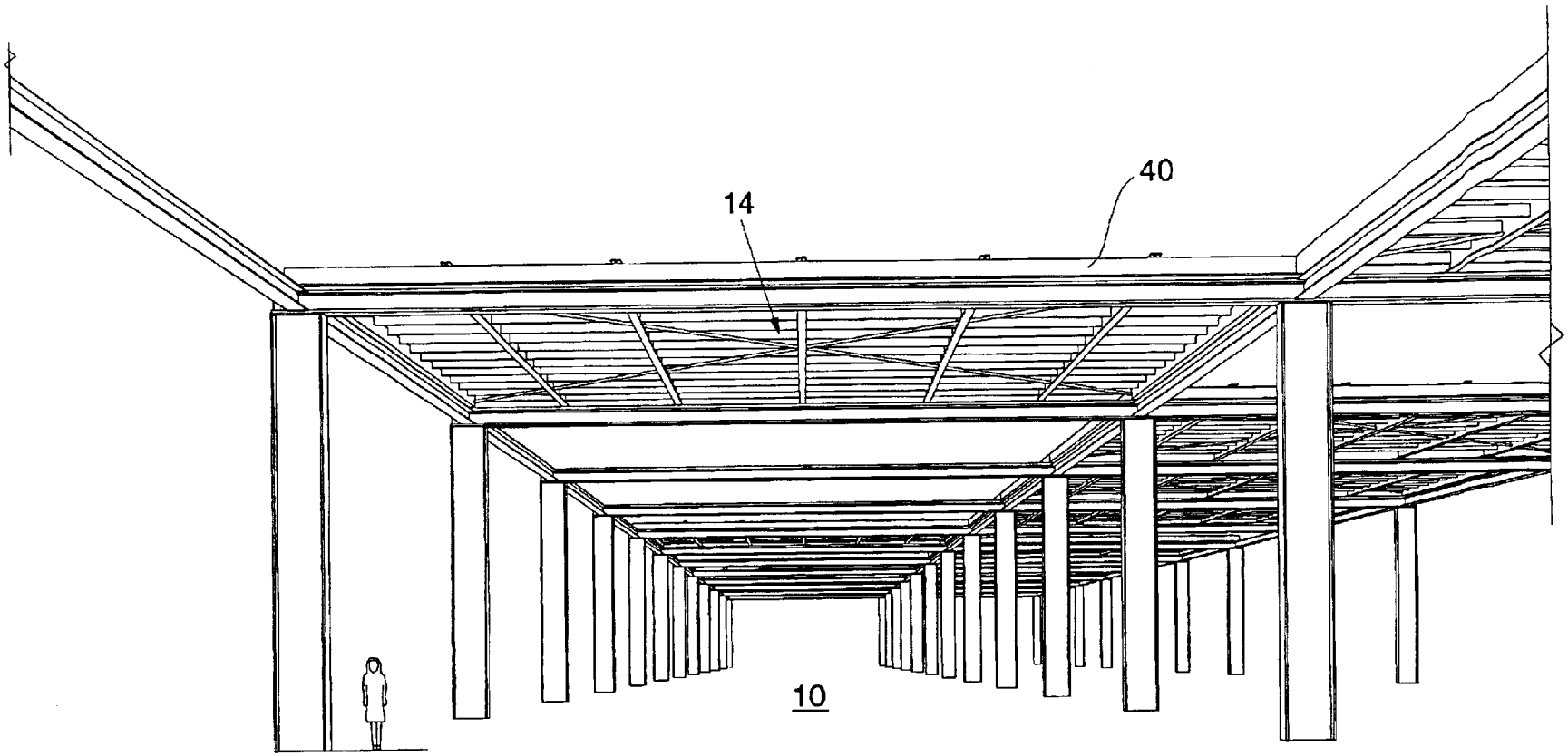
FIG. 7 is a perspective view from a bottom vantage point showing a segmental retractable flat roof partially opened over a mall walkway or other space by sliding parts of the roof on guide beams to the side.
Figure 8:
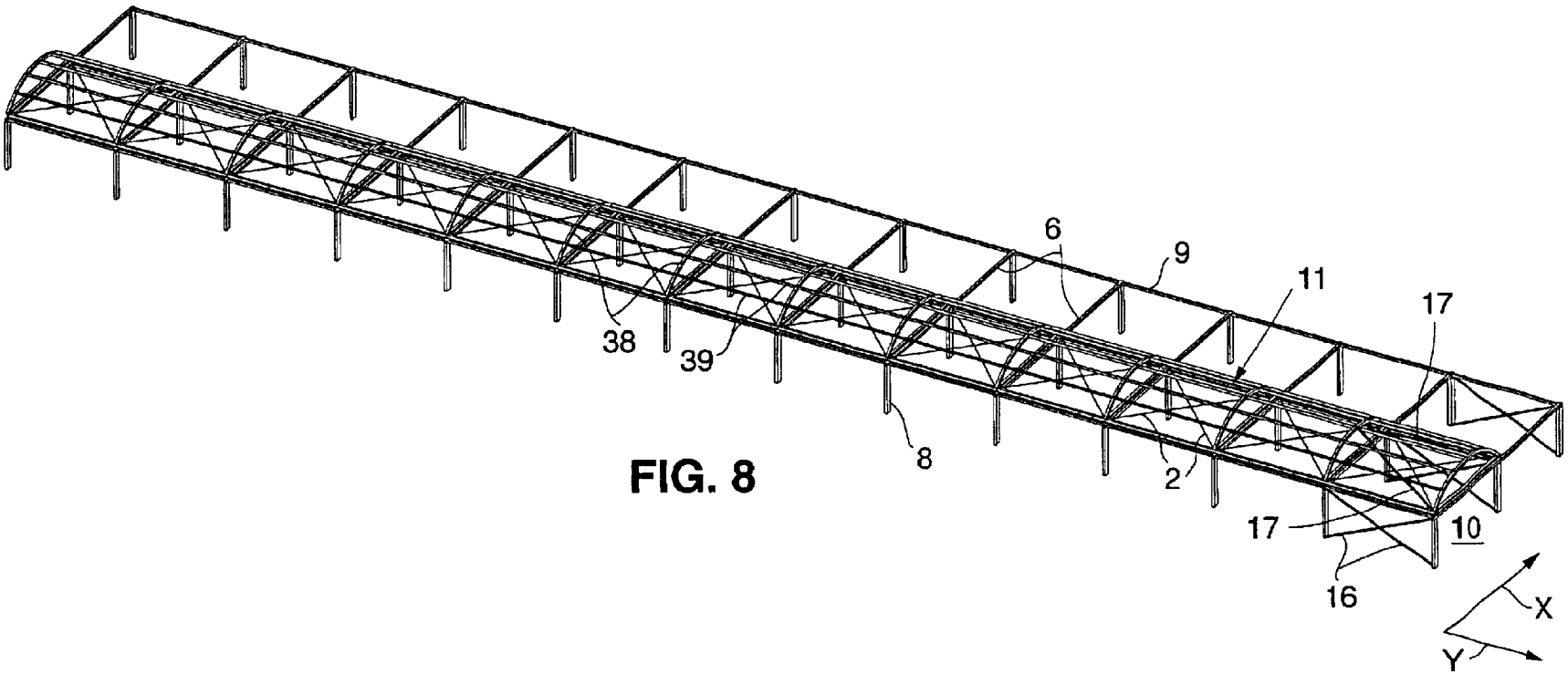
FIG. 8 is a diagrammatic perspective view from a top vantage point, showing the full length of the retractable roof system of FIG. 2A.

The segmental retractable flat roof in FIG. 7 varies from the monolithic flat roof in that a drainage channel is provided along the side of the sliding roof section 40 and separate sliding bearing pads 32 are provided for each roof section.

Figure 15:
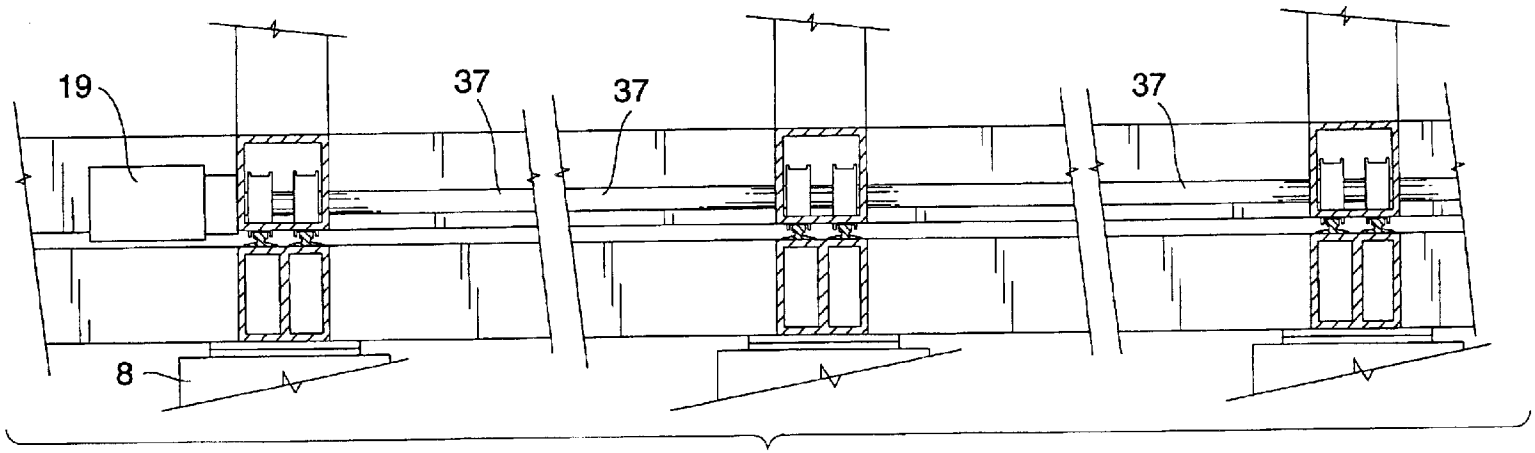
FIG. 15 is a cross-sectional elevation view similar to FIG. 13 illustrating a motor driven wheel arrangement for moving the retractable roof, where a single motor drives a plurality of wheels through drive shafts connecting the wheels.
Figure 18:
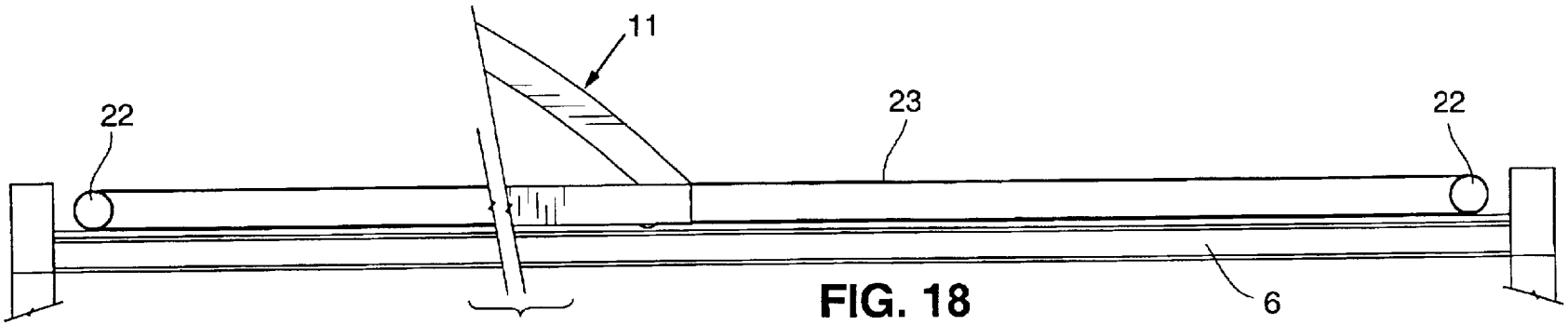
FIG. 18 is a side elevational view, with parts thereof broken away, diagrammatically illustrating a cable drive system which may be used to move the roof structure between the open and the closed condition.
Figure 19:
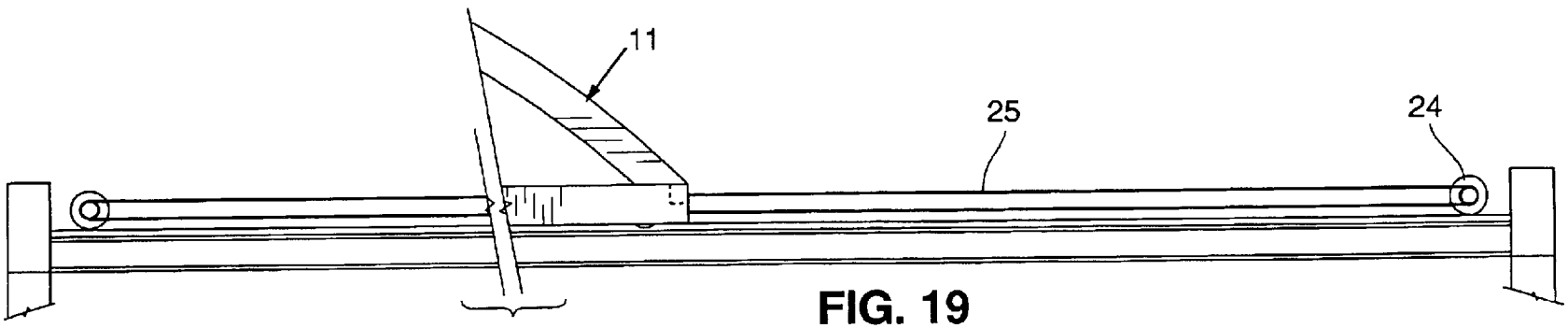
FIG. 19 is a side elevational view, with parts broken away, diagrammatically illustrating a reversible chain drive system which may be used to move the roof structure from the open to the closed condition.
Figure 20:
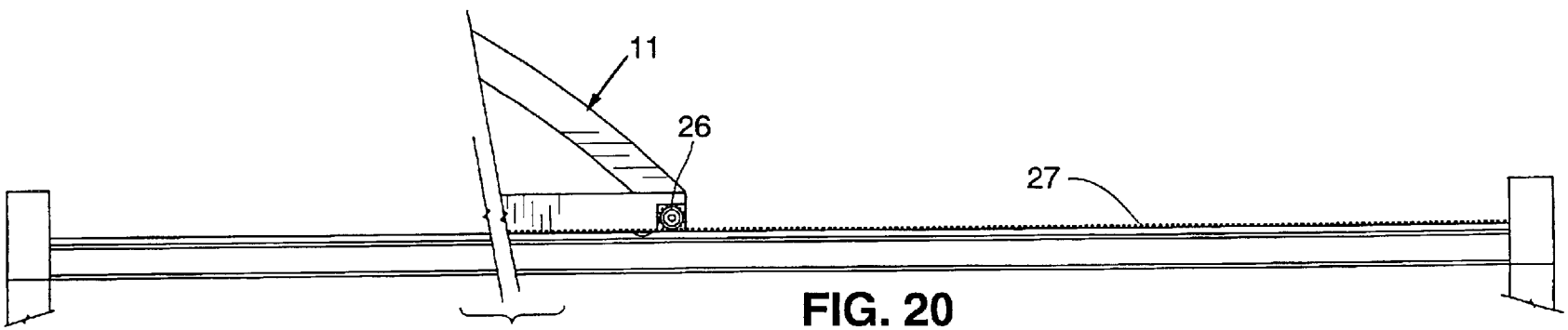
FIG. 20 is a side elevational view, with parts broken away, diagrammatically illustrating a rack and pinion drive system which may be used to move the roof structure from the open to the closed condition.
Figure 21:
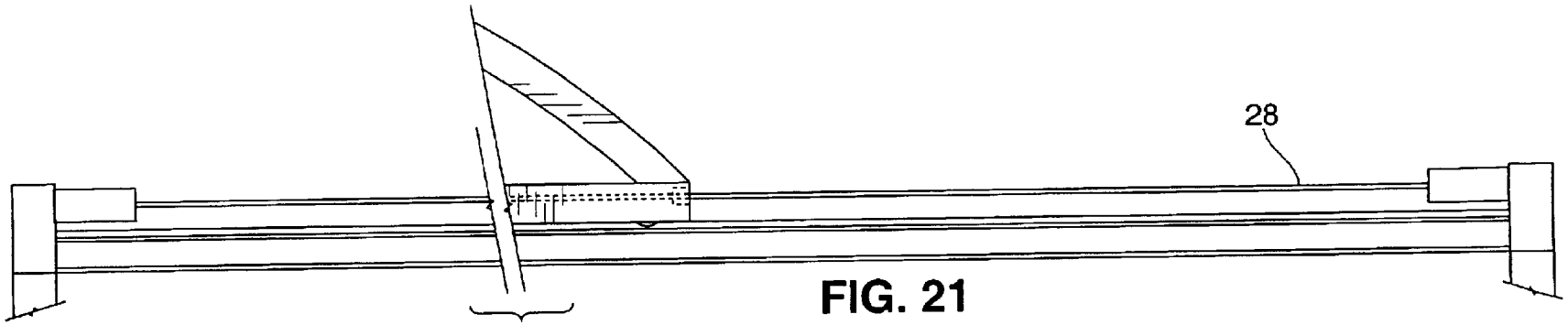
FIG. 21 is a side elevational view, with parts broken away, diagrammatically illustrating a worm screw drive system which may be used to move the roof structure between the open and the closed condition.
Figure 22:
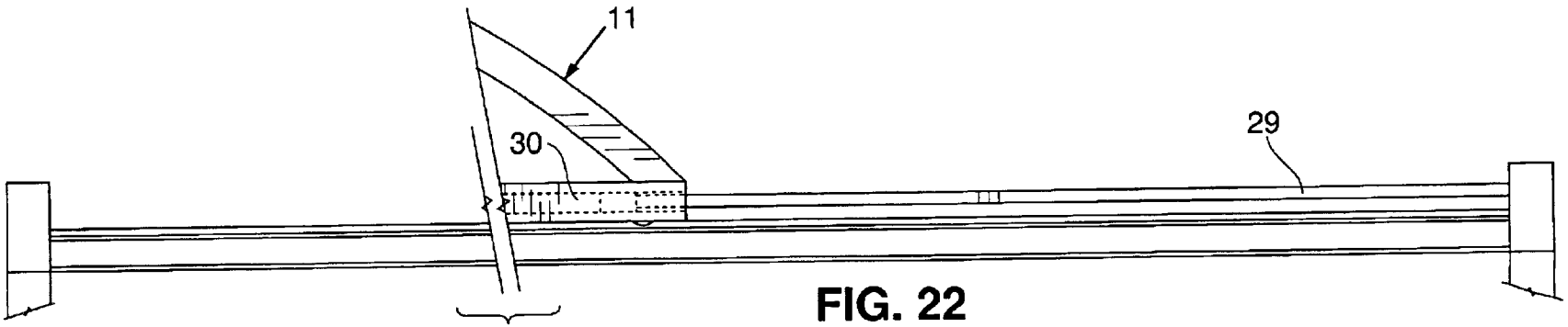
FIG. 22 is a side elevational view, with parts broken away, diagrammatically illustrating a hydraulic cylinder drive system which may be used to move the roof from the open to the closed condition.

Although the preferred embodiment would have motor driven wheels, other means to move the roof may be a winch and cable system as in FIG. 18, or a reversible chain as in FIG. 19, or a rack and pinion system as in FIG. 20, or a motor driven worm screw as in FIG. 21, or a hydraulic cylinder system as in FIG. 22, or a motor and shaft system driving multiple wheels as in FIG. 15.

Although the preferred embodiment would have x bracing as shown in FIG. 9 as a means to brace the supporting frame 1, other means may be a rectangular framework as in FIG. 10, or rigid corner bracing as in FIG. 11, or a shear diaphragm as in FIG. 12.

It is to be understood that while the subject invention has been described with reference to a preferred design, other designs could be made by one skilled in the art without varying from the scope and the spirit of the subject invention as defined by the appended claims.

What is claimed is:

1. A monolithic retractable barrel vaulted roof system for a mall or other large area comprising:

support structure for the retractable roof system disposed at spaced locations about the area;

sliding bearing pads on the support structure that permit temperature expansion and contraction;

an intermediate a frame set on the sliding bearing pads, said frame being made of a multiple of parallel beams and perpendicular intermediate beams and being of an area which spans the support structure between the spaced locations;

rails set on the parallel beams;

wheels set on the rails;

a supporting framework set on the wheels, said framework extending over and between adjacent parallel beams;

a barrel vaulted roof set on the supporting framework;

a roof cover set on the barrel vaulted roof;

bracing means of the supporting framework;

drive means to move the supporting framework to open or close the roof.

2. A roof system according to claim 1 wherein the roof bracing means is a horizontal X bracing.

3. A monolithic retractable pitched vaulted roof system for a mall or other large area comprising:

support structure for the retractable roof system disposed at spaced locations about the area;

sliding bearing pads on the support structure that permit temperature expansion and contraction;

an intermediate a frame set on the sliding bearing pads, said frame being made of a multiple of parallel beams and perpendicular intermediate beams and being of an area which spans the support structure between the spaced locations;

rails set on the parallel beams;

wheels set on the rails;

a supporting framework set on the wheels, said framework extending over and between adjacent parallel beams;

a pitched vaulted roof set on the supporting framework;

a roof cover set on the pitched vaulted roof;

bracing means of the supporting framework;

drive means to move the supporting framework to open or close the roof.

4. A roof system according to claim 3 wherein the roof bracing means is a horizontal X bracing.

5. A monolithic retractable flat roof system for a mall or other large area comprising:

support structure for the retractable roof system disposed at spaced locations about the area;

sliding bearing pads on the support structure that permit temperature expansion and contraction;

an intermediate frame set on the sliding bearing pads, said frame being made of a multiple of parallel beams and perpendicular intermediate beams and being of an area which spans the support structure between the spaced locations;

rails set on the parallel beams;

wheels set on the rails;

a supporting framework set on the wheels, said framework extending over and between adjacent parallel beams;

flat roof with the top surface sloped for drainage set on the supporting framework;

a roof cover set on the barrel vaulted roof;

bracing means of the supporting framework;

drive means to move the supporting framework to open or close the roof.

6. A roof system according to claim 5 wherein the bracing means is a horizontal X bracing.

7. A segmental retractable flat roof system for a mall or other large area comprising:

support structure for the retractable roof system disposed at spaced locations about the area;

an intermediate a frame disposed above on the support structure, said frame being made of multiple parallel beams and perpendicular intermediate beams;

means supporting the frame on the support structure, said means permitting relative movement between the support structure and frame to accommodate temperature expansion and contraction;

rails set on the parallel beams;

wheels set on the rails;

a supporting framework set on the wheels, said framework extending over and between adjacent parallel beams;

a flat roof set on the supporting framework;

a roof cover set on the flat roof;

a drainage channel on a flat roof segment;

bracing means for reinforcing the supporting framework;

drive means to move the supporting framework on the rails to open and close the roof.

8. A roof system according to claim 7 wherein the bracing means is a horizontal X bracing.

9. A retractable roof system for a mall or other large area comprising:

support structure for the retractable roof system disposed at spaced locations about the area;

sliding bearing pads on the support structure that permit temperature expansion and contraction;

an intermediate a frame set on the bearing pads, said frame being made of parallel beams and perpendicular intermediate beams and being of an area which spans the support structure between the spaced locations;

rails set on the parallel beams;

wheels set on the rails;

a supporting framework set on the wheels, said framework extending over and between adjacent parallel beams;

a roof with a cover set on the supporting framework;

bracing means for reinforcing the supporting framework;

drive means to move the supporting framework to open and close the roof.

10. A roof system according to claim 9 wherein the bracing means is a horizontal X bracing.

11. A roof system according to claim 1 or 2 or 3 or 4 or 5 or 6 or 7 or 8 or 9 or 10 wherein the drive means are motors attached to the wheels.

12. A roof system according to claim 1 or 2 or 3 or 4 or 5 or 6 or 7 or 8 or 9 or 10 wherein the drive means is a reversible chain and motor assembly.

13. A roof system according to claim 1 or 2 or 3 or 4 or 5 or 6 or 7 or 8 or 9 or 10 wherein the drive means is a rack and pinion system.

14. A roof system according to claim 1 or 2 or 3 or 5 or 6 or 7 or 8 or 9 or 10 wherein the roof cover is a glass skylight construction.

15. A roof system according to claims 1 or 2 or 3 or 4 or 5 or 6 or 7 or 8 or 9 or 10 wherein the drive means is a motorized worm screw.

16. A roof system according to claim 1 or 2 or 3 or 4 or 5 or 6 or 7 or 8 or 9 or 10 wherein the drive means is a hydraulic cylinder and piston.

17. A retractable roof system for an elongate area, said system comprising:

a. support structures to either side of the area;

b. an intermediate frame extending over the support structures and having a first portion spanning the area and a second portion disposed laterally of the area, said frame being of a length generally commensurate with that of the area and comprising:

i. elongate beams extending over the length thereof; and, ii. transverse beams secured to and extending across the elongate beams as spaced intervals;

c. bearing elements disposed between the frame and the support structures to support the frame on the structures while permitting relative movement between the frame and the structures to accommodate thermal expansion and contraction;

d. a monolithic roof structure supported on the frame for movement transversely relative thereto between a first condition extending over the area and a second condition disposed at least partially laterally of the area.

18. A system according to claim 17 further comprising means for selectively moving the roof structure between the first and second conditions.

19. A system according to claim 17 wherein the roof structure is of an elongate barrel vaulted configuration having a longitudinal axis and movement of the roof structure between the first and second conditions is in a direction transverse to the axis.

20. A system according to claim 17 wherein, when disposed in the second condition, the roof structure is disposed over and supported at least in part by the second portion of the intermediate frame.

21. A system according to claim 17 wherein the roof structure is supported on the frame by roller elements disposed between the roof structure and the transverse beams.

22. A system according to claim 17 wherein the intermediate frame has a part secured against movement relative to at least one of the support structures to restrain the frame against displacement from the structures; while permitting remaining parts of the frame to expand and contract relative to the support structures.

23. A system according to claim 22 wherein the roof structure has roller supports in aligned engagement with the transverse beams to support the roof structure on the intermediate frame at spaced intervals corresponding to the spacing of the transverse beams.

24. A system according to claim 17 wherein the roof structure comprises:

a. an elongate framework disposed in opposed generally parallel relationship to the intermediate frame, said framework extending longitudinally of the frame and having roller supports in aligned engagement with the spaced transverse beams to support the framework at spaced intervals corresponding to the spacing of the transverse beams; and, b. a roof secured to and extending over the framework, said roof being of an elongate barrel-shaped configuration and having a longitudinal axis extending lengthwise of the framework.

25. A system according to claim 24 wherein the framework has a length corresponding to that of the frame and comprises:

a. elongate side members extending over the length thereof;

b. cross-members extending between said side members at spaced intervals to divide the framework into segments, each of which segments is bounded by the elongate side members and a pair of cross-members; and, c. reinforcing elements within at least certain of the segments to brace the side and cross-members of the framework against movement relative to one another.

26. A retractable roof system, comprising:

a. support structures to either side of an area to be covered;

b. an intermediate frame spanning the area to be covered, said frame being disposed over the support structures and having spaced beams extending transversely thereacross and between the support structures;

c. bearing elements disposed between the frame and the support structures to support the frame on the structures while permitting relative movement between the frame and the structures to accommodate thermal expansion and contraction;

d. a roof structure supported on the frame for movement relative thereto between a first condition extending over the area between the structures and a second condition disposed at least partially laterally of the area.

27. A system according to claim 26 further comprising means for selectively moving the roof structure between the first and second conditions.

28. A system according to claim 26 wherein the roof structure is of a pitched vaulted configuration having a longitudinal axis and movement of the roof structure between the open and closed conditions is in a direction transverse to the axis.

29. A system according to claim 26 wherein:

a. the intermediate frame is elongate with opposite end portions separated by a longitudinally extensive body portion;

b. one end portion is secured against movement relative to at least one of the support structures; and, c. the bearing elements support the longitudinally extensive body portion to accommodate thermal expansion and contraction of the frame relative to the support structures.

30. A system according to claim 29 wherein the roof structure has roller supports in aligned engagement with the spaced beams to support the roof structure over the length thereof at spaced intervals corresponding to the spacing of the beams.

31. A system according to claim 26 wherein the roof structure comprises:

a. an elongate framework disposed in opposed generally parallel relationship to the intermediate frame, said framework extending longitudinally of the frame and having roller supports in aligned engagement with the spaced beams to support the framework at spaced intervals corresponding to the spacing of the beams; and, b. a roof secured to and extending over the framework, said roof being of a pitched vaulted shape and having a longitudinal axis extending lengthwise of the framework.

32. A system according to claim 31 wherein the framework has a length corresponding to that of the of the frame and comprises:

a. elongate side members extending over the length thereof;

b. cross-members extending between said side members at spaced intervals to divide the framework into segments, each of which segments is bounded by the elongate side members and a pair of cross-members; and, c. reinforcing elements within at least certain of the segments to brace the side and cross-members of the framework against movement relative to one another.

33. A retractable roof system, comprising:

a. support structures to either side of an area to be covered;

b. an elongate intermediate frame spanning the area to be covered, said frame resting on the support structures for movement relative thereto to permit thermal expansion and contraction and having spaced beams extending transversely thereacross between the support structures;

c. a roof structure supported on the frame, said roof structure comprising:

i. an elongate framework disposed in opposed generally parallel relationship to the intermediate frame, said framework extending longitudinally of the frame and having beams extending thereacross in aligned apposition to the spaced beams of the intermediate frame; and, ii. a roof secured to and extending over the framework, said roof being of flat configuration and having a longitudinal axis extending lengthwise of the framework;

d. roller supports engaged between the aligned beams of the intermediate frame and roof framework to support the roof framework for movement across the intermediate frame in a direction transverse to the longitudinal axis of the roof, between a first condition extending over the area to be covered and a second condition disposed at least partially laterally of the area.

34. A system according to claim 33 further comprising means for selectively moving the roof structure between the first and second conditions.

35. A system according to claim 33 wherein a discrete portion of the frame is anchored against longitudinal movement relative to the support structure.

36. A retractable roof system for an elongate area, said system comprising:

a. a support structure to either side of the area;

b. an elongate intermediate frame supported by the support structures in a horizontal disposition extending over the area for movement relative thereto to permit thermal expansion and contraction, said frame being of a length generally commensurate with that of the area and comprising:

i. elongate beams extending over the length thereof; and, ii. transverse beams secured to and extending across the elongate beams at spaced intervals;

c. a monolithic roof structure supported on the frame for movement transversely relative thereto between a first condition extending over the area and a second condition disposed at least partially laterally of the area, said structure comprising:

i. an elongate framework disposed in opposed generally parallel relationship to the intermediate frame, said framework extending longitudinally over the frame and having roller supports in aligned engagement with the spaced beams to support the framework at spaced intervals corresponding to the spacing of the beams; and, ii. a roof secured to and extending over the framework;

d. means for selectively moving the framework between the first and second conditions.

37. A system according to claim 36 wherein the roof structure is of an elongate flat segmental configuration having a longitudinal axis and movement of the roof structure between the open and closed conditions is in a direction transverse to the axis.

38. A system according to claim 36 wherein the framework has a length corresponding to that of the of the frame and comprises:

a. elongate side members extending over the length thereof;

b. cross-members extending between said side members at spaced intervals to divide the framework into segments, each of which segments is bounded by the elongate side members and a pair of cross-members; and, c. reinforcing elements within at least certain of the segments to brace the side and cross-members of the framework against movement relative to one another.

39. A system according to claim 38 wherein:

a. the cross-members of the framework are aligned with the transverse beams of the frame;

b. the roller supports are carried by the framework and aligned with the cross-members.

40. A method of constructing a retractable roof system for an expansive elongate area, said method comprising:

a. providing fixed support structures to either side of the area;

b. disposing an elongate monolithic intermediate frame having spaced cross-beams over the support structures in spanning relationship to the area so that the beams extend transversely across the area;

c. supporting the frame on the support structures through means of bearing elements disposed between the frame and the support structures which permit relative movement between the frame and the structures to accommodate thermal expansion and contraction;

d. supporting a monolithic roof structure on the frame for movement relative thereto in a direction transverse to the elongate area between a first condition extending over the area and a second condition disposed at least partially laterally of the area.

41. A method according to claim 40 wherein the roof structure is of a single panel flat configuration having a longitudinal axis and is mounted for movement between the open and closed conditions in a direction transverse to the axis.

42. A method according to claim 40, further comprising providing means for selectively moving the roof structure between the first and second conditions.

43. A method according to claim 40, further comprising providing rollers on the roof structure in aligned engagement with the beams to rollably support the roof structure on the frame for movement between the first and second conditions.

44. A method according to claim 40 further comprising securing one end of the frame against movement relative to at least one of the support structures to maintain the frame in alignment with the structures while permitting the frame to thermally expand and contract.

* * * * *